US010011385B2

(12) United States Patent
Zeljic et al.

(10) Patent No.: US 10,011,385 B2
(45) Date of Patent: Jul. 3, 2018

(54) LABEL APPLICATOR

(71) Applicant: bioMerieux, Inc., Durham, NC (US)

(72) Inventors: Dejan Zeljic, St. Louis, MO (US); James Killala-Ringwood, Leigh-On-Sea (GB); Daniel Joseph Pingel, St. Peters, MO (US); Daniel Oliver Luebbert, St. Peters, MO (US)

(73) Assignee: bioMerieux, Inc., Durham, NC (US)

( * ) Notice: Subject to any disclaimer, the term of this patent is extended or adjusted under 35 U.S.C. 154(b) by 0 days.

(21) Appl. No.: 14/978,246

(22) Filed: Dec. 22, 2015

(65) Prior Publication Data

US 2016/0185478 A1 Jun. 30, 2016

Related U.S. Application Data

(60) Provisional application No. 62/096,614, filed on Dec. 24, 2014.

(51) Int. Cl.
*B65C 9/26* (2006.01)
*B65C 9/36* (2006.01)
(Continued)

(52) U.S. Cl.
CPC ..... *B65C 9/26* (2013.01); *B65C 3/00* (2013.01); *B65C 9/0006* (2013.01); *B65C 9/36* (2013.01); *B65C 2210/0008* (2013.01)

(58) Field of Classification Search
CPC .. B65C 3/00; B65C 3/08; B65C 3/105; B65C 9/0006; B65C 9/26; B65C 9/36;
(Continued)

(56) References Cited

U.S. PATENT DOCUMENTS 1,536,836 A 5/1925 Fredsell
2,319,969 A * 5/1943 Besemer ..... B65C 9/36 118/31.5
(Continued)

FOREIGN PATENT DOCUMENTS

DE 10 80 923 4/1960
EP 2 481 675 A2 8/2012
(Continued)

OTHER PUBLICATIONS

International Search Report and the Written Opinion of the International Searching Authority corresponding to International Patent Application No. PCT/US2015/067438 (13 pages) (dated Apr. 4, 2016).

*Primary Examiner* — George Koch
(74) *Attorney, Agent, or Firm* — Myers Bigel, P.A.

(57) ABSTRACT

A label applicator, system, and method for applying labels to curved sides of objects, such as cell culture dishes, is provided. In an aspect, the label applicator includes a body having a first side and a second side, the second side comprising a curved surface; a base; at least one first resilient member having a defined length between a first end and a second end; and at least one second resilient member engaging the body and the base, wherein the second end of the at least one first resilient member is configured to removably attach to a label and, when the label is in contact with the second end and an object, to apply a pressure to the label that increases as the at least one first resilient member and at least one second resilient member are compressed. The system may also include a label verifier and/or label verification system.

15 Claims, 14 Drawing Sheets

(51) Int. Cl.
*B65C 3/00* (2006.01)
*B65C 9/00* (2006.01)

(58) Field of Classification Search
CPC ..... B65C 9/40; B65C 2009/402; B65C 2009/407; B65C 2210/0008
USPC ..... 156/358, 378
See application file for complete search history.

(56) References Cited

U.S. PATENT DOCUMENTS

| | | | | |
|---|---|---|---|---|
| 3,823,050 | A | 7/1974 | La Mers | |
| 5,540,795 | A | 7/1996 | Franklin et al. | |
| 5,865,918 | A * | 2/1999 | Franklin | B65C 9/1826 156/363 |

FOREIGN PATENT DOCUMENTS

| | | | |
|---|---|---|---|
| EP | 2 712 819 | A1 | 4/2014 |
| WO | WO 2010/048242 | A1 | 4/2010 |

* cited by examiner

LABEL APPLICATOR

RELATED APPLICATION INFORMATION

This application claims the benefit of U.S. Provisional Patent Application Ser. No. 62/096,614, filed Dec. 24, 2014, the disclosure of which is incorporated herein by reference in its entirety.

FIELD OF THE INVENTION

The present application is directed to a device, system, and method for applying labels to the curved sides of objects, such as, for example, Petri dishes. The system may be incorporated into an automated instrument for printing, applying, and/or verifying application of the labels to the sides of objects of different sizes and/or diameters.

BACKGROUND

Labeling and verification of labels on cell culture dishes is important for the accurate detection of pathogenic microorganisms in the cell culture dishes. Instruments currently exist on the market in the U.S. that prepare cell culture dishes for use in the identification of microorganisms. One such instrument is the PREVI Isola instrument of the present assignee bioMérieux, Inc. This instrument is used with automated pre-poured media (i.e., pre-poured media in Petri or cell culture dishes) that can be streaked with a microbiology specimen.

In order to accommodate multiple culture protocols PREVI Isola can hold up to five different medias. The different pre-poured media (PPM) can have different diameters and/or heights. Currently, a label with user and plate panel information is applied to the bottom of each dish. This is achieved by moving the dish base above the printed and presented label. The printed label is positioned with adhesive facing the bottom of the dish and is applied to the bottom of the dish base during the dish transfer.

It may be desirable for a label applicator to apply labels on the sides of round surfaces of objects, e.g., dishes having different diameters.

SUMMARY

The present device, system and method provide label applicators, label applicator systems, verification devices, and methods of applying labels to curved surfaces of objects. In a first aspect, a label applicator is provided. In an embodiment, the label applicator includes a body having a first side and a second side, the second side comprising a curved surface; a base positioned proximate to the first side of the body; at least one first resilient member having a defined length between a first end and a second end; and at least one second resilient member engaging the body and the base, wherein the second end of the at least one first resilient member is configured to removably attach to a label and, when the label is in contact with the second end and an object, to apply a pressure to the label that increases as the at least one first resilient member and at least one second resilient member are compressed.

In some embodiments, the at least one first resilient member is selected from the group consisting of a spring and a pneumatic device. In further embodiments, the at least one second resilient member is selected from the group consisting of a spring, a compressive polymer, a pneumatic device, foam, and a bladder.

In some embodiments, the label applicator further includes at least one pathway extending from the first side of the body to the curved surface on the second side of the body, wherein the at least one first resilient member extends through the at least one pathway, the first end of the at least one first resilient member engages with the base, and the second end of the at least one first resilient member extends beyond the curved surface. In an embodiment, the at least one pathway comprises two channels defined by the body, the two channels positioned on opposite sides of a midpoint of the curved surface.

In an embodiment, the label applicator further includes an adhesive member on the second end of the at least one first resilient member. For example, the adhesive member may be selected from the group consisting of a suction cup, an adhesive surface, a magnet, and a vacuum tube.

In some embodiments, the label applicator further includes a resilient surface attached to the curved surface. For example, the resilient surface may be selected from the group consisting of a foam pad, a spring-loaded surface, and a bladder.

In a second aspect, a label applicator system is provided. In an embodiment, the label applicator system includes a label applicator comprising: a body having a first side and a second side and defining two channels extending through the body from the first side to a curved surface on the second side, the two channels positioned on opposing sides of a midpoint of the curved surface; a base positioned proximate to the first side of the body; a first pair of resilient members extending through the two channels and having a first end engaging with the base and a second end at a position beyond the curved surface; a second pair of resilient members engaging with the body and the base, and wherein the second ends of the first pair of resilient members are configured to removably attach to a label.

In some embodiments, the label applicator system includes adhesive members attached to the second ends of the first pair of resilient members, the adhesive members selected from the group consisting of suction cups, adhesive surfaces, magnets, and vacuum tubes.

In an embodiment, the label applicator system includes a resilient surface attached to the curved surface, the resilient surface selected from the group consisting of a foam pad, a spring-loaded surface, and a bladder.

In a further embodiment, the label applicator system includes a movable arm configured to move the base of the label applicator.

In some embodiments, the label applicator system includes a step motor operably connected to the movable arm and configured to move the movable arm in at least one plane.

In an embodiment, the label applicator system includes a pressure sensor configured to monitor an application force of the label applicator by the step motor and halt movement of the label applicator when a predetermined limit is exceeded. In some embodiments, the system monitors a stepper motor that drive a specific axis in order to recognize step loss in the motor In further embodiments, the label applicator system includes a scanner configured to capture information on the label after the label has been applied to a curved surface of an object.

In some embodiments, the label applicator system includes a scanner controller and a hinge, wherein the scanner controller sweeps the scanner in a vertical direction on the hinge to capture the information on the label.

In a further aspect, a method of applying a label to a curved surface of an object is provided. In some embodiments, the method includes providing a label applicator comprising: a body having a first side and a second side; a base positioned proximate to the first side of the body; at least one first resilient member having a defined length between a first end and a second end; and at least one second resilient member engaging the body and the base, wherein the second end of the at least one first resilient member is configured to removably attach to a label and, when the label is in contact with the second end and an object, to apply a pressure to the label that increases as the at least one first resilient member and at least one second resilient member are compressed; attaching the label to the second end of the at least one first resilient member; moving the label applicator towards an object having a curved surface; adhering the label to the curved surface using an increasing application force based at least on the first resilient member and the second resilient member; and detaching the label from the second end of the at least one first resilient member.

In some embodiments, the method further includes scanning the label using a scanner; and confirming that the object has been labeled.

In an embodiment, the method includes monitoring the increasing application force; and, responsive to monitoring the increasing application force, halting movement of the label applicator towards the object when the increasing application force exceeds a predetermined limit.

In some embodiments, the increasing application force is further based on: a suction cup attached to the second end of the at least one first resilient member, and a resilient surface attached to the second side.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE DRAWINGS

The present invention of this disclosure will be described in conjunction with the appended drawings, in which.

DETAILED DESCRIPTION

Figure 1:
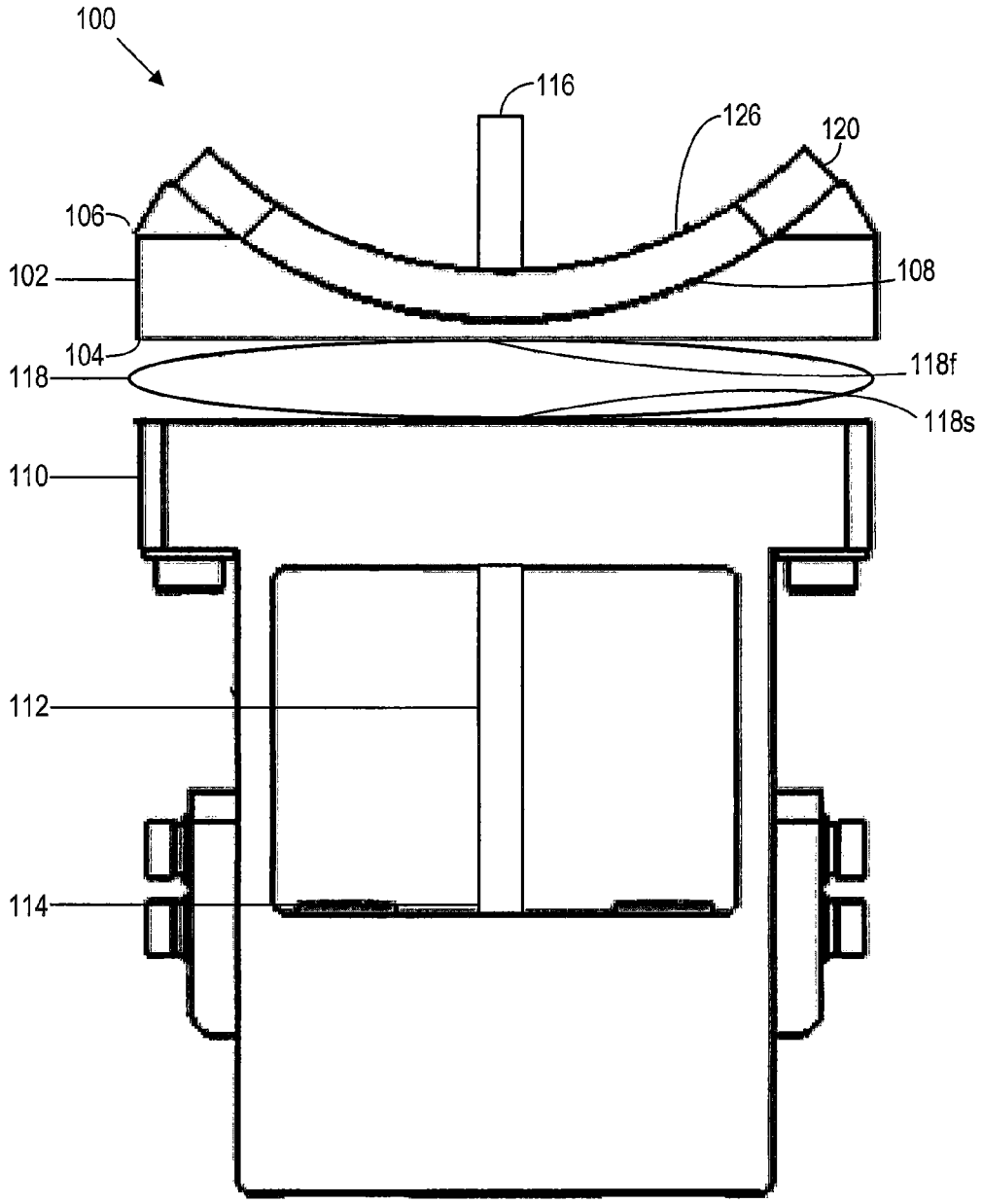
FIG. 1 is a view of a label applicator for applying a label to an object having a curved surface, in accordance with an embodiment of this disclosure.

The present invention will now be described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. It will be appreciated that although discussed with respect to a certain embodiment, a feature or operation of one embodiment can apply to others.

In the drawings, the thickness of lines, layers, features, components and/or regions may be exaggerated for clarity. In addition, the sequence of operations (or steps) is not limited to the order presented in the claims unless specifically indicated otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. While the term "comprising" may be used herein, it should be understood that the objects referred to as "comprising" elements may also "consist of" or "consist essentially of" the elements. As used herein, the term "and/or" includes any and all combinations of one or more of the associated listed items. Like numbers refer to like elements throughout. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having, a meaning that is consistent with their meaning in the context of the specification and relevant art and should not be interpreted in an idealized or overly formal sense unless expressly so defined herein. Well-known functions or constructions may not be described in detail for brevity and/or clarity.

The terms "automatically", "automatic", "automated", and grammatical variations thereof mean that the operation can be substantially, and typically entirely, carried out without human and/or manual input, and is typically electronically and/or programmatically directed or carried out. The term "electronically" refers to all forms of machine based operation and includes both wireless and wired connections, including both wireless and wired connections between components. The term "about" means that the recited parameter or value can vary by between about +/−20% (e.g., +/−15%, +/−10%, or +/−5%).

The present disclosure relates to a label applicator, label applicator system, and method for applying a label to a curved surface of an object. The label applicator and/or label applicator system may be incorporated into an automated system and/or instrument for applying a label to a side of an object, such as, for example, a Petri and/or cell culture dish. One embodiment of the label applicator, label applicator system, and/or method for applying a label to a curved surface is described herein in conjunction with FIGS. 1-14. The label applicator and/or label applicator system may include one or more of the following features: (1) a body comprising a curved surface; (2) a base proximate in location to the body; (3) one or more first resilient members configured to attach to a label; (4) one or more second resilient members engaging and/or attached and/or coupled to the body and the base; and/or (5) a resilient surface attached to the curved surface of the body. One or more of these features may allow the label applicator to gradually increase the application pressure of a label against a curved surface of an object to which the label is being applied. In some embodiments, the label applicator may be used to apply labels to objects having different sizes and/or diameters.

In order to better appreciate how the illustrated embodiment of a label applicator and/or label applicator system operates, this specification will provide examples in the context of a particular instrument (i.e., a label applicator for applying labels to the curved sides of objects) and a particular specimen container (i.e., a Petri dish and/or cell culture dish). However, persons skilled in the art will readily appreciate that the invention can be practiced in other embodiments, that variations from the specific embodiments disclosed herein can be arrived at to suit particular implementations, and that therefore the present description of an embodiment and best mode for practicing the invention is provided by way of illustration and not limitation.

When applying labels to a curved side of an object, step loss may be a problem when a high force is quickly applied to a stepper motor controlling the application of the label. Step loss may cause the stepper motor to stall and/or a loss in synchronization and/or steps. Gradually increasing the application force of the label to the surface of the object has been found to reduce the problems associated with step loss. Thus, in some embodiments, a four-stage applicator mechanism design, such as, for example, described in reference to FIGS. 6-9, may be used to enable application force to be gradually transferred to objects with different sizes and/or diameters, which may prevent or reduce step loss in the stepper motor.

In some embodiments, a label applicator for applying a label to an object having a curved surface is provided. In an embodiment, the object is a Petri dish and/or cell culture dish for culturing a test sample. In general, any known test sample (e.g., a biological sample) can be used. For example, the test sample can be a clinical and/or non-clinical sample suspected of containing one or more microbial agents. Clinical samples, such as a bodily fluid, include, but are not limited to, blood, serum, plasma, blood fractions, joint fluid, urine, semen, saliva, feces, cerebrospinal fluid, gastric contents, vaginal secretions, tissue homogenates, bone marrow aspirates, bone homogenates, sputum, aspirates, swabs and swab rinsates, other body fluids, and the like. Non-clinical samples that may be tested include, but are not limited to, foodstuffs, beverages, pharmaceuticals, cosmetics, water (e.g., drinking water, non-potable water, and waste water), seawater ballasts, air, soil, sewage, plant material (e.g., seeds, leaves, stems, roots, flowers, fruit), blood products (e.g., platelets, serum, plasma, white blood cell fractions, etc.), donor organ or tissue samples, biowarfare samples, and the like. In one embodiment, the biological sample tested is a blood sample. While this specification discloses application of labels to cell culture dishes, this is for example purposes only and the device, system, and method may be adapted for applying labels to other types of objects having a curved surface.

As used herein, a label provides or can provide information related to the object to which it is applied. For example, the label may provide information including, but not limited to, the date, time, and/or contents of the object (e.g., media type, sample type (e.g., clinical and/or non-clinical), and/or sample source). A label may be an adhesive label and/or may attach to an adhesive surface on the object. The label may be paper, polymeric, metallic, etc., or a combination thereof. In an example embodiment, the label is printed with information prior to being adhered to the object. In some embodiments, however, the label is blank and is printed on after being adhered to the object.

In some embodiments, a label applicator may apply a label to the side of an object such that the label will not obstruct projected and/or emitted light from underneath and/or above the object (e.g., underneath the dish base), such as, for example, when an image of the streaked specimen is taken. Thus, the label may not obstruct the light and/or may not affect the quality of an image taken above and/or below an object. In addition, since the label is on the side of object it may be visible by a user, such as, for example, when the object is stacked with others.

Referring now to FIGS. 1-13, several configurations are possible for the label applicator device and system. As shown in FIG. 1, in some embodiments, the label applicator 100 includes a body 102 having a first side 104 and a second side 106, the second side comprising a curved surface 108. In some embodiments, the label applicator 100 also includes a base 110 positioned proximate to the first side 104 of the body 102. In an embodiment, the label applicator 100 includes at least one first resilient member 112 having a defined length between a first end 114 and a second end 116, wherein the second end 116 applies an increasing pressure to an object (e.g., to a curved side of an object) as the at least one first resilient member 112 is compressed (e.g., as the distance between the first end 114 and second end 116 decreases). Thus, the pressure applied to an object (e.g., to a curved side of an object) by the second end 116 of the at least one first resilient member 112 may increase as the distance between the first end 114 and second end 116 decreases. In an embodiment, the second end 116 of the at least one first resilient member 112 is configured to removably attach to a label at a position beyond the curved surface 108. The second end 116 may attach to and/or hold a label for a period of time and then may release and/or remove the label at a certain point in time (e.g., when and/or after the label is attached to the side of an object). In some embodiments, when the second end 116 releases and/or removes the label the second end 116 is no longer in contact with the label.

In an embodiment, the label applicator 100 further includes at least one second resilient member 118 attached and/or coupled to and/or engaging the body 102 and the base 110. In some embodiments, a first end 118*f* of the at least one second resilient member 118 may be attached and/or coupled to and/or engaged with the body 102 and a second end 118*s* of the at least one second resilient member 118 may be attached and/or coupled to and/or engaged with the base 110. The at least one second resilient member 118 may apply an increasing pressure as the at least one second resilient member 118 is compressed (e.g., as the distance between the first end 118*f* and second end 118*s* decreases). Thus, the pressure applied to an object (e.g., to a curved side of an object) by the at least one second resilient member 118 may increase as the distance between the first end 118*f* and second end 118*s* decreases and/or as the distance between the body 102 and base 110 decreases.

In a further embodiment, the label applicator 100 also includes a resilient surface 120 attached to the curved surface 108. The resilient surface 120 may comprise an outer curved resilient surface 126, which may contact the object, such as the side of an object. In some embodiments, the outer curved resilient surface 126 may have a shape and/or curvature similar to that of curved surface 108 and/or the curved surface 108 and/or thickness of the resilient surface 120 may determine the shape and/or degree of curvature of the outer curved resilient surface 126. The structure of the label applicator 100 may permit an increasing application force to be applied to the label and the curved surface of an object, and thereby may reduce step loss in a motor controlling the label applicator.

In an embodiment, the body 102 and base 110 are rigid structures relative to the first resilient member 112 and the second resilient member 118. The body 102 and base 110 may be made from any known material, for example, plastic, wood, and/or metal. As shown in FIG. 1, the body 102 may include a generally rectangular shape on the first side 104 and the curved surface 108 on the second side 106. The length, width, and height dimensions of the body 102 are not critical to the implementation of the device and will vary depending on the object to which the label will be applied. In some embodiments, the height dimension of the body 102 and/or the curved surface 108 of the body 102 will be a height sufficient to apply the label to the side of a Petri dish. For example, the height of the body 102 and/or the curved surface 108 of the body 102 may be +/−20% or any range and/or value therein (e.g., +/−15%, 10%, 5%, or 1%) of the height of the object to which a label is to be applied and/or may be the same height as the object.

In an embodiment, the outer curved resilient surface 126 and/or the curved surface 108 is configured to compress a label against the side of an object. In some embodiments, the outer curved resilient surface 126 and resilient surface 120 are not present and the curved surface 108 is configured to compress a label against the side of an object. In some embodiments, the curved surface 108 and/or the outer curved resilient surface 126 are concave. As used herein, concave means curved or hollowed inward like the inside of a circle. The curved surface 108 and/or the outer curved resilient surface 126 may be concave relative to the base 102 and/or body 110 (i.e, the curve is inward toward the base 102 and/or body 110). The degree of concavity and size of the curved surface 108 and/or the outer curved resilient surface 126 will vary depending on the size or range of sizes of the curved surfaces to which the label will be applied. In one embodiment, the curved surface 108 and/or outer curved resilient surface 126 has size dimensions and/or a degree of concavity such that the side of an object (e.g., a Petri dish) matches the curved surface 108 and/or outer curved resilient surface 126 along at least the length of the label when the curved surface 108 and/or outer curved resilient surface 126 is applied to the side of the object. In this manner, the curved surface 108 and/or outer curved resilient surface 126 matches the curvature of the object and compresses the label against the side of the object along the length of the label.

In some embodiments, the label applicator 100 is configured to apply labels to objects having a variety of sizes (i.e., different diameters, different shapes, different heights, etc.). For example, the label applicator 100 may be configured to work with Petri dishes having different diameters, such as from 85-88 mm. In some embodiments, the label applicator includes a curved surface 108 and/or outer curved resilient surface 126 that has dimensions suitable for applying a label to a side of an object (e.g., a Petri dish), the object having a diameter of 30, 35, 40, 45, 50, 55, 60, 65, 70, 75, 80, 85, 90, 95, 100, 105, 110, 115, 120, 125, and/or 130 mm and/or any range and/or number therein.

In some embodiments, the label applicator 100 is configured to apply labels to objects having different diameters due to the inclusion of a resilient surface 120 attached to the curved surface 108. When the label applicator 100 presses the outer curved resilient surface 126 into the side of the object, the outer curved resilient surface 126 and/or resilient surface 120 attached to the curved surface 108 conforms to the shape of the object and contacts and/or compresses the label against the object. In this way, labels may be applied to a range of objects including objects having different degrees of curvature on the surface (e.g., side surface) because the outer curved resilient surface 126 and/or resilient surface 120 can conform to a range of diameters and/or degrees of curvature. In some embodiments, the resilient surface 120 and/or outer curved resilient surface 126 may compress towards the body 102 when in contact with the object and the compression may increase as the application force to the object increases. In some embodiments, at least a portion of the resilient surface 120 may be reduced in thickness and/or width when the outer curved resilient surface 126 is in contact with the object compared to the thickness and/or width of that portion when the outer curved resilient surface 126 is not in contact with the object. As the application force to the object increases, the distance between the outer curved resilient surface 126 and curved surface 108 may decrease for at least a portion of the resilient surface 120. In some embodiments, the resilient surface 120 and/or outer curved resilient surface 126 may return to its shape (e.g., expanded and/or non-compressed shape) prior to contact with the object.

In some embodiments, the resilient surface 120 is a foam substance that compresses and then rebounds once compression is released and/or once the object is not in contact with the outer curved resilient surface 126. The foam may be natural and/or artificial. In some embodiments, the foam has a minimum level or maximum level of resiliency or compliancy. For example, the foam may have a compression deflection of about 25% at 48 kPa. The foam may be configured to mold around the side of the object and apply continuous pressure along the length of a label.

In further embodiments, the resilient surface 120 is a bladder. For example, the bladder may be a liquid or air-filled bladder or balloon. In an embodiment, the bladder is positioned between the curved surface 108 and the label. The bladder may conform to the label and/or compress the label against the side of the object. In some embodiments, the bladder includes a flexible band having a flat surface that is designed to compress the label against the side of the object.

In some embodiments, the resilient surface 120 is a spring-loaded surface that conforms to the side of object as the springs compress. For example, a flexible band may be mounted on the curved surface 108 via a plurality of springs. As the flexible band presses against the side of the object, the springs compress and the flexible band conforms to the side of the object, thereby compressing the label against the side of the object.

In some embodiments, the label applicator 100 includes a base 110. As disclosed herein, the body 102 and the base 110 are configured to move relative to one another. For example, the body 102 may move while the base 110 is secured to a device (e.g., an arm, etc.). The form factor of the base may be modified according to standard industrial practices. In some embodiments, the base 110 is solid, while in other embodiments the base is at least partially hollow.

As shown in FIG. 1, the base 110 is positioned proximate to the first side 104 of the body 102. In an example embodiment, the base 110 is positioned proximate to the first side 104 of the body 102 such that when the base 110 is advanced towards an object, the body 102 is between the base 110 and the object and the curved surface 108 on the second side 106 of the body 102 and/or outer curved resilient surface 126 presses against the object.

In an embodiment, the label applicator 100 includes at least one first resilient member 112 having a first end 114, a second end 116, and a defined length. The first resilient member 112 may be a spring, pneumatic device, or other device configured to compress and then rebound after compression is relieved. In an example embodiment, the first resilient member is secured to the base 110 at the first end 114 and is configured to removably attach to a label at the second end 116. When the label applicator 100 is advanced towards an object, the second end 116 of the first resilient member 112 contacts the object and the first resilient member 112 begins to compress.

The first resilient member 112 may be external to the body 102 and/or the base 110. For example, the first resilient member 112 may be positioned above, below, or to the side of the body 102 and/or the base 110. In another embodiment, at least a portion of the first resilient member 112 may pass through the body 102 and/or the base 110. For example, the first resilient member 112 may pass through a channel defined in the surface of the body 102 and/or the base 110. In another example, the first resilient member 112 may pass through a channel defined within the body 102 and/or the base 110. In some embodiments, the first resilient member 112 is encased in a tube. Any of these relationships between the first resilient member 112, the body 102, and the base 110 may be referred to as a pathway of the first resilient member 112.

In an embodiment, the first resilient member 112 is a spring having a length and a spring constant value related to the degree of resiliency of the spring. For example, the first resilient member 112 may have a spring rate c1=0.117+/−0.012 N/mm. In an embodiment, the spring constant is selected based on the rigidity of the object and the degree of resiliency in other elements of the label applicator 100. For example, the spring constant for the first resilient member 112 may be selected so that the Petri dish is not damaged when the first resilient member 112 contacts the Petri dish. Similarly, the spring constant for the first resilient member 112 may be selected so that the force applied by the label applicator 100 gradually increases as the second resilient member 118, resilient surface 120, and/or adhesive member 224 (seen in FIG. 2) are engaged.

In an embodiment, the second end 116 applies an increasing pressure as the at least one first resilient member 112 is compressed. In some embodiments, the second end 116 applies a pressure that increases as the distance between the first end 114 and second end 116 decreases. For example, the first resilient member 112 may be a spring that increases pressure at the second end 116 when the first end 114 is secured and the spring is compressed. Similarly, the first resilient member 112 may be a pneumatic device that increases pressure when compressed and then returns to a neutral state when compression is released.

In an embodiment, the second end 116 of the first resilient member 112 is configured to removably attach to a label. For example, the second end 116 may comprise an adhesive member 224 (seen in FIG. 2) such as, e.g., a suction cup, vacuum tube, magnet, adhesive pad, or the like. In some embodiments, the second end 116 and/or adhesive member 224 may removably attach to a label in that the second end 116 and/or adhesive member 224 may contact, hold and/or attach to at least a portion of the label and may subsequently release and/or no longer contact the label. In some embodiments, the second end 116 and/or adhesive member 224 may contact, hold and/or attach to a portion of the label that does not contact the object. For example, the second end 116 and/or adhesive member 224 may attach to the outer face of the label and the inner face of the label attaches to the object. In some embodiments, the adhesive member 224 may receive a label, attach (e.g., reversibly attach) to the label, and then release the label after the label is attached to the side of the object. In some embodiments, the label applicator 100 is moved to a printer that prepares the label and the second end 116 and/or adhesive member 224 attaches to the label at that point. In another embodiment, the label applicator 100 remains stationary and the label is moved to a position to attach to the second end 116 and/or adhesive member 224. In some embodiments, to release the label, the label applicator 100, second end 116, and/or adhesive member 224 may be moved away from the object and/or the object may be moved away from the label applicator 100, second end 116, and/or adhesive member 224. In some embodiments, the adhesive force between the label and the object may be high enough to detach the label from the second end 116, and/or adhesive member 224 when the label applicator 100, second end 116, and/or adhesive member 224 is separated from the object.

In a first embodiment, the adhesive member on the second end 116 is a suction cup having a vacuum line attached. The suction cup is configured to attach to a label when a solenoid valve associated with the vacuum line is opened. In some embodiments, the suction cup is resilient and deforms when the suction cup and label are initially applied to the side of the object. For example, the label applicator 100 having a label attached to the second end 116 via a suction cup may be advanced towards the side of a Petri dish. When the label initially contacts the side of the Petri dish, the suction cup deforms and provides a low application force to the label and the side of the Petri dish.

In some embodiments, the adhesive member on the second end 116 is a magnet configured to attach to the label. The magnet may be an electromagnet or a permanent magnet. In some embodiments, an electromagnet is used so that the adhesive nature of the adhesive member may be turned off when the label is attached to the side of the object. In an embodiment, the magnet is weaker than the adhesive forces that secure the label to the side of the object. For example, the label may adhere to the side of a Petri dish via an adhesive glue. The adhesive force of the adhesive glue may be high enough to detach the label from the magnet on the second end 116 of the first resilient member 112 when the label applicator 100 is separated from the object.

In an embodiment, the adhesive member is an adhesive pad that secures to the label. Again, the attachment force of the adhesive pad may be less than the adhesive forces of the label when it is attached to the side of the object, and therefore the label detaches from the second end 116 of the first resilient member 112 when the object is separated from the label applicator 100. In some embodiments, the adhesive pad comprises a resilient surface (e.g., a padded or stuffed body) that applies an initial low level of pressure to the side of the object when the label is initially applied to the object.

In some embodiments, the second end 116 is configured to removably attach to a label by having a surface for receiving an adhesive label. In some embodiments, a label may have an adhesive substance on both sides. The label may adhere to the surface for receiving an adhesive label on the second end 116 of the first resilient member 112 via the adhesive substance. When the label is brought into contact with the side of the object, the adhesive substance on the reverse side adheres to the side of the object. In an embodiment, the adhesive force between the label and the side of the object is greater than the adhesive force between the label and the second end 116 and therefore the label detaches from the second end 116 when the object is separated from the label applicator 100. In some embodiments, the surface for receiving the adhesive label also comprises a resilient surface that applies an initial low level of pressure to the side of the object when the label is initially applied to the object.

It should be understood that other types of adhesive members may be positioned on the second end 116 of the first resilient member 112. For example, clips may be used to grasp the label or a static or electric device may be used to generate an adhesive force between the second end 116 and the label.

In an embodiment, the first resilient member 112 is positioned relative to the body 102 such that the second end 116 is at a position beyond the curved surface 108 and/or outer curved resilient surface 126 when the label applicator 100 is in a neutral (i.e., uncompressed) position. As shown in FIG. 1, the second end 116 is positioned beyond the curved surface 108 and outer curved resilient surface 126, and the first resilient member 112 extends towards the body 102 to the first end 114. The second end 116 may be positioned within the arc of the curved surface 108 and/or outer curved resilient surface 126 or beyond the arc of the curved surface and/or outer curved resilient surface 126 (as shown in FIG. 1) when in the neutral position. As the first resilient member 112 is compressed, the second end 116 moves towards the curved surface 108 and/or outer curved resilient surface 126 and in some embodiments meets or is received into the curved surface 108 and/or outer curved resilient surface 126.

In an embodiment, the label applicator 100 comprises at least one second resilient member 118 engaging the body 102 and the base 110. The at least one second resilient member 118 may be attached and/or coupled to the body 102 and the base 110. As shown in FIG. 1, the second resilient member 118 may be between the body 102 and the base 110. In some embodiments, the second resilient member 118 is positioned to the side of the body 102 and/or the base 110. In an embodiment, at least a portion of the second resilient member 118 is within the body 102 and/or the base 110.

In an embodiment, the second resilient member 118 engages both the body 102 and the base 110. For example, the second resilient member 118 may be attached to the body 102 and/or the base 110. In another embodiment, the second resilient member 118 engages with the body 102 and the base 110 but is not attached to the body 102 and/or the base 110. For example, the second resilient member 118 may be a spring within a tube connecting the body 102 and the base 110.

The second resilient member 118 engages the body 102 and the base 110 such that the second resilient member 118 compresses when the body 102 and/or base 110 are moved from a neutral position. For example, the label applicator 100 may be advanced towards an object. The first resilient member 112 may compress until the side of the object makes contact with the curved surface 108 and/or outer curved resilient surface 126. At this point, the body 102 is pushed towards the base 110 and the second resilient member 118 begins to be compressed. The label applicator 100 may also be moving and/or advanced toward the object, which may cause the base 110 to push toward the body 102 so that the second resilient member 118 is compressed. In an embodiment, the second resilient member 118 has a degree of resiliency (e.g., a spring constant) such that the application of force at the second end 116 gradually increases as the second resilient member 118 is compressed. For example, the second resilient member 118 may have a spring rate c2=0.167+/−0.017 N/mm. In an embodiment, the second resilient member 118 applies an increasing pressure over distance when the at least one second resilient member 118 is compressed. In some embodiments, as the distance between the first end 118*f* and the second end 118*s* of the second resilient member 118 decreases, the application of force at the second end 116 increases.

In some embodiments, the second resilient member 118 is a spring engaging (e.g., positioned between) the body 102 and the base 110. In an embodiment, the spring constant for the second resilient member 118 is selected based on the rigidity of the object and the degree of resiliency in other elements of the label applicator 100. For example, the spring constant for the second resilient member 118 may be selected so that the Petri dish is not damaged when the second resilient member 118 is engaged and/or compressed between the body 102 and the base 110. Similarly, the spring constant for the second resilient member 118 may be selected so that the force applied by the label applicator 100 gradually increases as the resilient surface 120 and/or the adhesive member are engaged. Similarly, the second resilient member 118 may be a pneumatic device that increases pressure when compressed and then returns to a neutral state when compression is released.

In some embodiments, the second resilient member 118 is a foam layer engaging the body 102 and the base 110. For example, a foam pad may be positioned between the body 102 and the base 110. In another embodiment, the second resilient member 118 is a bladder engaging the body 102 and the base 110. The bladder may be liquid and/or air-filled. In some embodiments, the bladder comprises a valve configured to relieve pressure when the bladder is compressed beyond a certain point. In this manner, rupturing of the bladder is prevented. In a still further embodiment, the second resilient member 118 is a compressive polymer engaging the body 102 and the base 110. For example, the second resilient member 118 may be a polymer substance that compresses under pressure, provides a resistant force when compressed, and returns to an expanded or neutral state when pressure is relieved.

Figure 2:
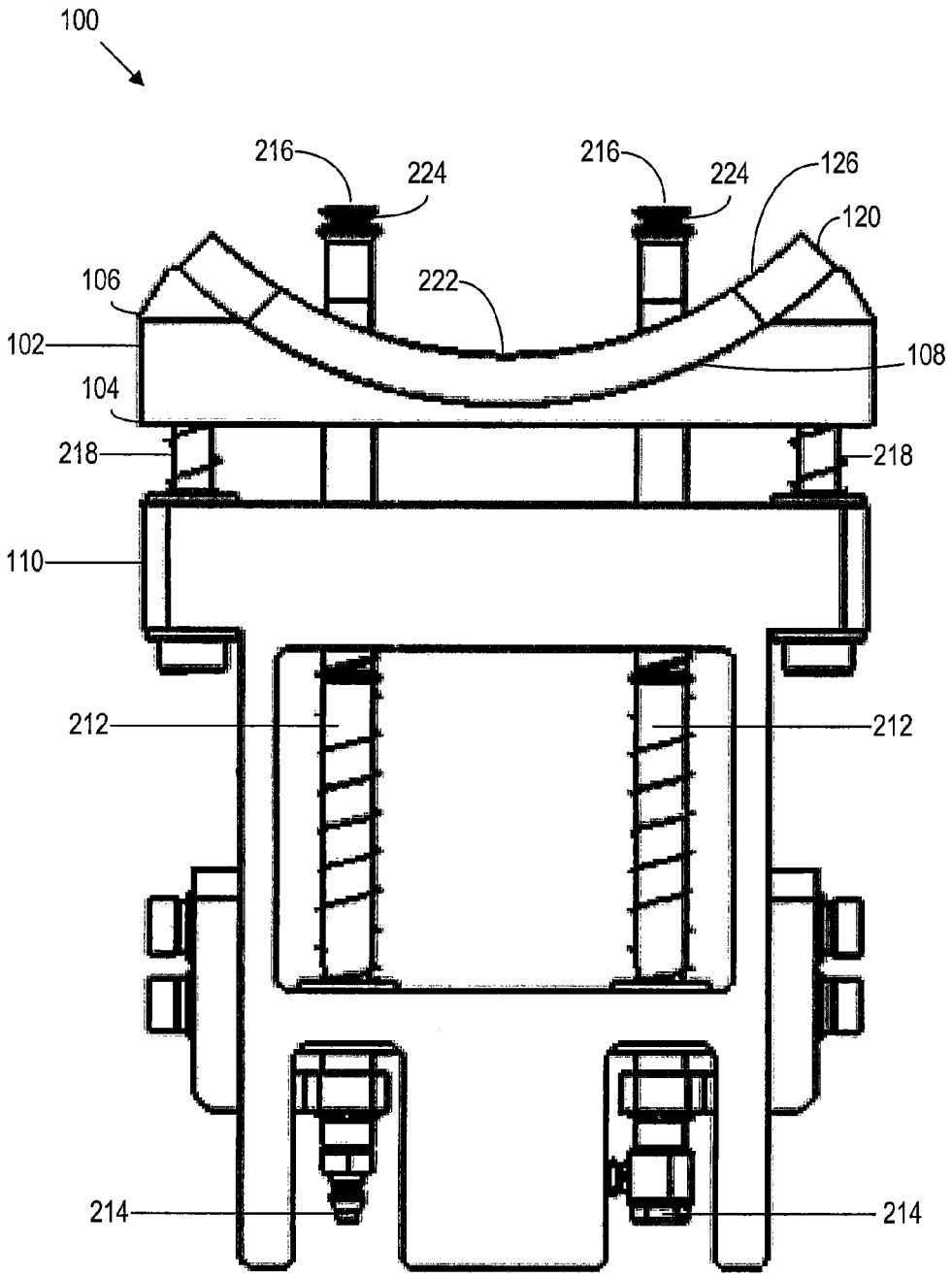
FIG. 2 is a view of a label applicator for applying a label to an object having a curved surface, in accordance with a second embodiment of this disclosure.

A specific embodiment of the label applicator 100 is shown in FIG. 2. As shown, the label applicator 100 includes the body 102 having the first side 104 and the second side 106. In this embodiment, the body 102 defines two channels (not shown) extending through the body 102 from the first side 104 to the curved surface 108 on the second side 106. In one embodiment, the two substantially parallel channels are positioned on opposing sides of a midpoint 222 of the curved surface 108. In an embodiment, the label applicator 100 includes the base 110 positioned proximate to the first side 104 of the body 102. In some embodiments, the at least one first resilient member of the label applicator 100 includes a first pair of resilient members 212 extending through the two substantially parallel channels and having a first end 214 engaging with the base 110 and a second end 216 at a position beyond the curved surface 108. The second ends 216 of the first pair of resilient members 212 may be configured to removably attach to a label, such as via adhesive members 224. In a further embodiment, the at least one second resilient member comprises a second pair of resilient members 218 engaging with the body 102 and the base 110. In a further embodiment, the label applicator 100 also includes a resilient surface 120 attached to the curved surface 108. The resilient surface may comprise an outer curved resilient surface 126.

In the embodiment shown in FIG. 2, the body 102 defines two channels (not shown) extending through the body 102 from the first side 104 to the curved surface 108 on the second side 106. In one embodiment, the channels are at least partially within the body 102 and/or the base 110. In some embodiments, the channels are defined and/or formed on the surface of the body 102 and/or the base 110. In some embodiments, the channels are substantially parallel to one another such that application of force at the second ends 216 compresses the first pair of resilient members 212 in the same direction.

In an embodiment, the two channels are positioned on opposing sides of midpoint 222 of the curved surface 108. In some embodiments, the channels are equidistant from the midpoint 222. In an embodiment, the channels are positioned at a distance from the midpoint 222 so that the channels are not farther apart than the width of a label. In an example embodiment, the channels open up into the curved surface 108 and/or outer curved resilient surface 126.

In the embodiment shown in FIG. 2, the at least one first resilient member of the label applicator 100 includes a first pair of resilient members 212 extending through the two channels and having a first end 214 engaging with the base 110 and a second end 216 at a position beyond the curved surface 108 and outer curved resilient surface 126. The first pair of resilient members 212 are shown as springs in FIG. 2, however other resilient devices (e.g., pneumatic devices) may be used. FIG. 2 also illustrates a cutaway view of a tube surrounding the spring. The tube is present between the body 102 and the base 110 but not within the base 110. It should be understood that the tube may be present throughout the entire length of the first pair of resilient members 212.

In this embodiment, the first pair of resilient members 212 engage with the base 110 via a bracket (see FIG. 4) proximate to the first ends 214. Other ways of engaging the first pair of resilient members 212 with the base 110 are possible.

In some embodiments, the second ends 216 of the first pair of resilient members 212 pass through openings defined in the curved surface 108 and/or outer curved resilient surface 126 (see FIG. 5) and end at a position beyond the curved surface 108 and/or outer curved resilient surface 126. As shown in FIG. 2, the second ends 216 extend beyond the arc defined by the curved surface 108 and outer curved resilient surface 126, but this is not necessary and the second ends 216 may also be within the arc defined by the curved surface 108 and/or outer curved resilient surface 126 when the label applicator 100 is at a neutral position.

In an embodiment, the second ends 216 of the first pair of resilient members 212 are configured to removably attach to a label, such as via an adhesive member 224. As discussed with respect to FIG. 1, the adhesive member 224 may be a suction cup, a vacuum tube, an adhesive pad, a magnet, etc. In the embodiment shown in FIG. 2, the adhesive members 224 are suction cups that provide an initial low application force to the label and to the side of the object when contact is made.

In some embodiments, the at least one second resilient member includes a second pair of resilient members 218 engaging with the body 102 and the base 110. As shown in FIG. 2, the second pair of resilient members 218 may be a pair of springs positioned between the body 102 and the base 110. The second pair of resilient members 218 may begin to compress when the first pair of resilient members 212 are compressed such that the object comes into contact with the curved surface 108 and/or outer curved resilient surface 126.

Figure 3:
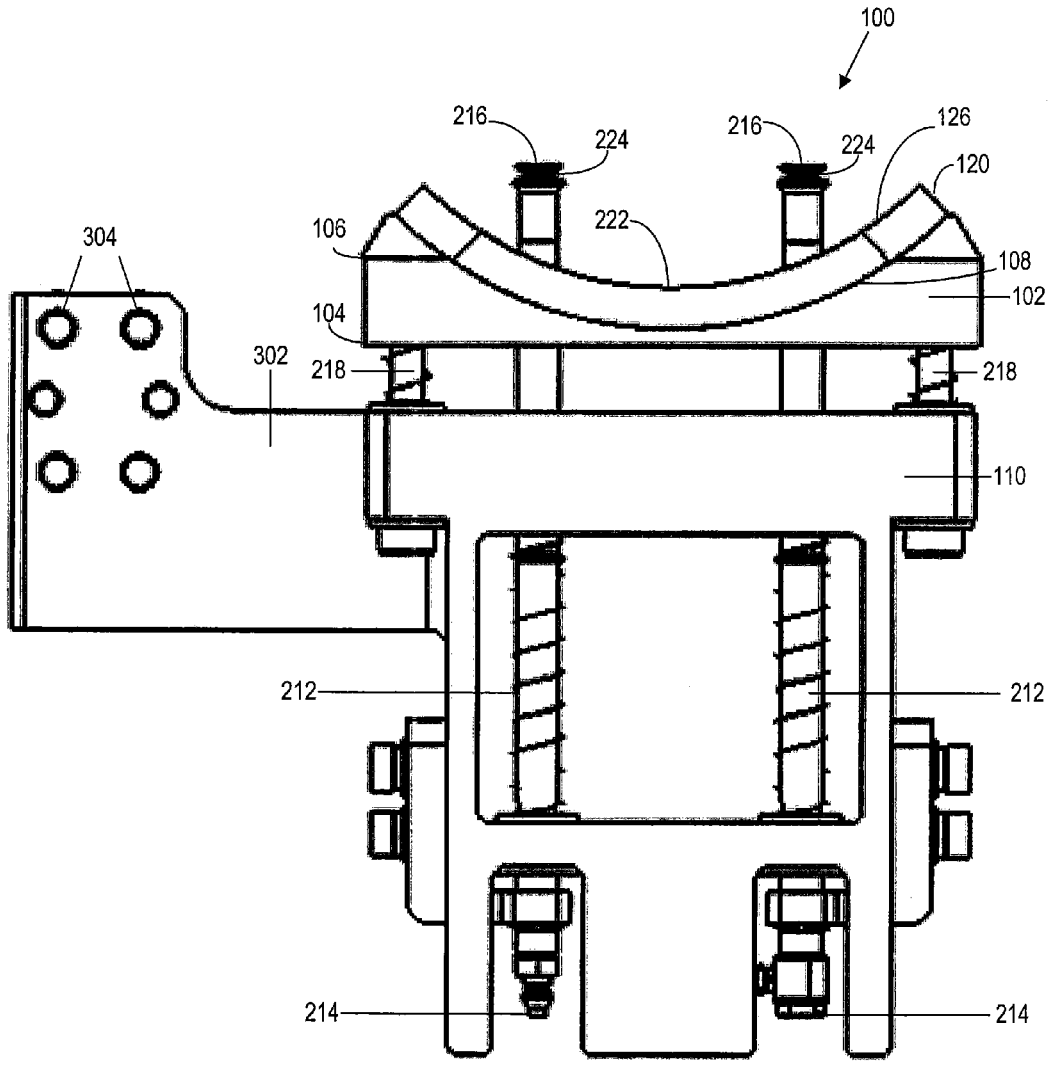
FIG. 3 is a view of a label applicator and an attachment device, in accordance with an embodiment of this disclosure.

Turning now to FIG. 3, a view of the label applicator 100 of FIG. 2 and an attachment device 302 is provided, in accordance with an embodiment of this disclosure. In this embodiment, the attachment device 302 attaches to the base 110. The attachment device 302 may be integral with the base 110 (e.g., formed of a single piece of material, such as, e.g., metal and/or polymer) or the attachment device 302 may be secured to the base 110 in some other way. For example, the attachment device 302 may be secured to the base 110 by welding, adhesive, screws, bolts, etc. In some embodiments, a portion of the attachment device 302 is configured to attach to an arm (see FIG. 5) and permits the arm to move the label applicator 100. In an embodiment, the attachment device 302 attaches to an immobile object to secure the label applicator 100 in place and the object having the curved surface is moved relative to the label applicator 100.

In some embodiments, the attachment device 302 comprises one or more securing devices 304, such as screws, bolts, and the like. The one or more securing devices 304 may secure the attachment device 302 to the label applicator 100 and/or to other devices, including an arm. In some embodiments, the one or more securing devices 304 are reversible and/or removable such that the label applicator 100 and/or attachment device 302 can be detached, such as, e.g., removed from the arm, for maintenance.

Figure 4:
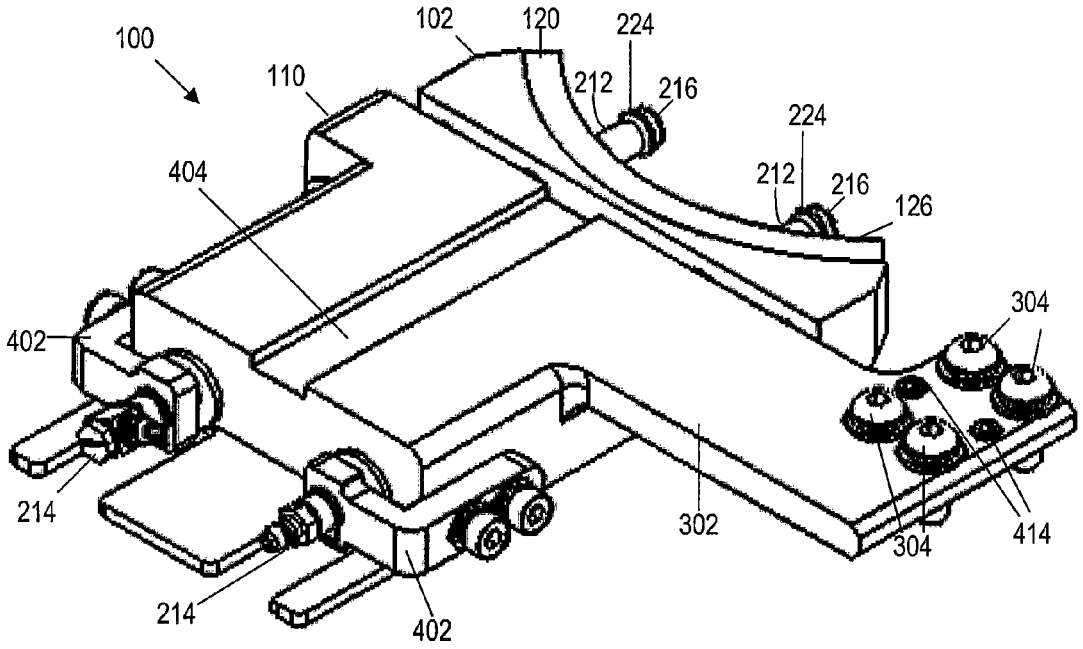
FIG. 4 is a perspective view of a label applicator showing a second view of the attachment device, in accordance with an embodiment of this disclosure.

FIG. 4 provides a perspective view of the label applicator 100 showing a second view of the attachment device 302, in accordance with an embodiment of this disclosure. In this view, the attachment device 302 is depicted as integral with the base 110. Four securing devices 304 are shown in openings defined by the attachment device 302, and two additional openings 414 are depicted. In some embodiments, the two openings 414 are configured to receive set screws and may be used for angular adjustment of the label applicator 100 about the center line (adjustment range +/−2 degrees).

FIG. 4 also shows a view of the engagement between the first pair of resilient members 212 and the base 110. In this embodiment, the first pair of resilient members 212 are attached to the base 110 via L-shaped brackets 402. As shown, the L-shaped brackets 402 attach to the first ends 214 of the first pair of resilient members 212 as well as to a side of the base 110. The brackets 402 may also be used to align the adhesive members 224 relative to each other so that both adhesive members 224 touch the label at the same time. For example, the brackets 402 may be able to adjust the adhesive members 224, such as, for example, +/−2 mm. It should be understood that the engagement between the first pair of resilient members 212 and the base 110 may be accomplished in an alternative manner.

In some embodiments, the base 110 includes a guide 404 that is configured to maintain the direction of movement when the label applicator 100 is advanced towards an object having a curved surface. For example, the guide 404 may be a groove that receives a ridge (not shown) as part of a label application system. In some embodiments, the guide 404 may be used to align the label applicator 100 to the object. The guide 404 and ridge together may permit forward and reverse movement but do not permit side-to-side movement. In this manner, the label applicator 100 moves towards and away from the object in a single direction and does not move laterally when applying a label. It should be understood that other types of guides may be used to direct the movement of the label applicator 100, such as external rails, an internal rod, or the like.

Figure 5:
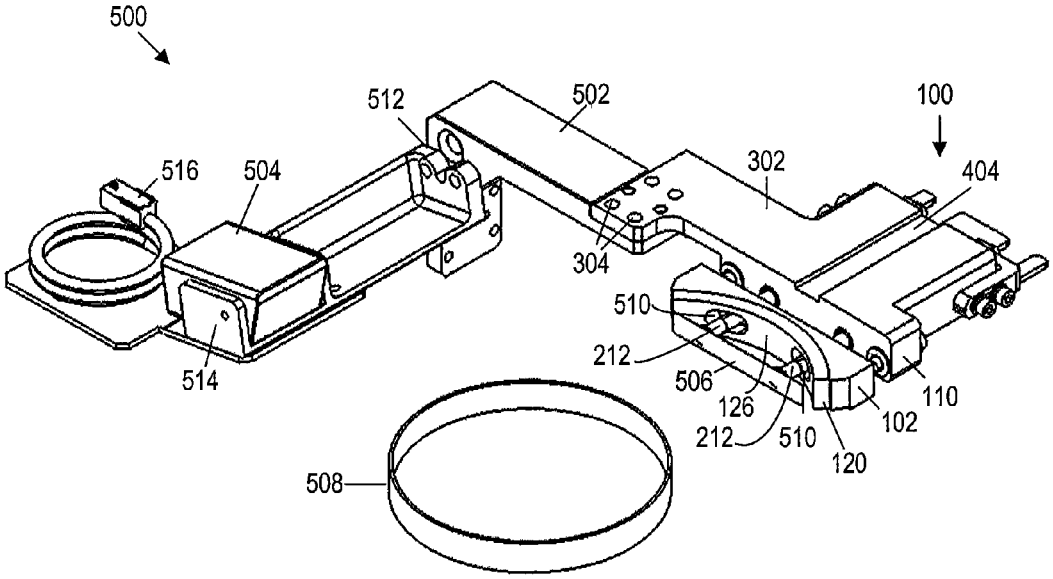
FIG. 5 is a perspective view of a label applicator, arm, and scanning device, in accordance with an embodiment of this disclosure.

Turning now to FIG. 5, a perspective view of a label applicator 100, arm 502, and scanner 504 is provided, in accordance with an embodiment of this disclosure. The label applicator 100, arm 502, and scanner 504 may be used as part of a system 500 for applying a label 506 to a curved side of an object 508, such as a Petri dish.

The label applicator 100 shown in FIG. 5 illustrates openings 510 defined in the curved surface 108 and outer curved resilient surface 126, and through which the first pair of resilient members 212 pass. The openings 510 may conform to the diameter of the first pair of resilient members 212 or may have a greater open area. As would be understood, too large of an opening size would limit the effectiveness of securing the label 506 to the side of the object 508. In some embodiments, the diameter and/or area of an opening 510 may be up to 20% greater than the diameter and/or area of the resilient member of the first pair of resilient members 212 that passes through the opening 510. The label 506 removably attaches to the first pair of resilient members 212 beyond the outer curved resilient surface 126. The body 102, base 110, and resilient surface 120 attached to the curved surface 108 are also illustrated.

The label applicator 100 is attached to the arm 502 via the attachment device 302 and a plurality of securing devices 304. In some embodiments, however, the label applicator 100 is integral with the arm 502. In some embodiments, the arm 502 includes one or more hinges 512 to permit movement in more than one direction. For example, in some embodiments the arm 502 moves in one plane (e.g., forward and backwards towards an object 508). In other embodiments, the arm 502 moves in more than one plane, such as, e.g., forward and backwards towards an object 508 and up and down to receive a label 506. In some embodiments, one or more hinges 512 position the scanner 504 at an angle (e.g., 10 degrees) relative to the horizontal plane to ensure that scanning is performed outside of a dead zone, which may be, for example, from −8 to +9 degrees. A motor (not shown), such as a stepper motor, may be included as part of the system 500 to power the arm 502 in one or more directions.

In some embodiments, the system 500 includes a scanner 504 that is configured to scan information on the label 506. The scanner 504 may associate with and/or be in electronic communication with a computing device processor (not shown) to confirm that the label 506 is correctly applied, readable, and/or that the content of the label is accurate, e.g., matches input information associated with the streaked patient specimen. The scanner 504 may be mounted in the system 500 on a vertical hinge 514 that permits vertical movement relative to the label 506 after the label 506 has been applied to the object 508. The scanner 504 may also include a communication device and/or power device 516 to communicate between the computing device processor and the scanner 504. The communication device and/or power device 516 may be in electronic communication with the computing device processor and/or the scanner 504. The scanner 504 may be used as part of a label verification process that will be discussed in more detail with respect to FIGS. 9-10.

In FIGS. 6-9, a view of the label applicator 100 at four different stages of label application is provided, in accordance with an embodiment of this disclosure. The four different stages of label application demonstrate how the label applicator 100 gradually increases application force of the label 506 against the side of the object in order to reduce step loss in the motor. It should be understood that the four stages are merely representative points within a continuous process. The label application process may halt between stages but does not need to halt between the stages discussed herein. In an embodiment, the different stages of label application are defined by engagement of different elements of the label applicator 100. In an example embodiment, the stages of label application go from the label applicator 100 being in a neutral position (i.e., uncompressed) to stages of gradually increasing application force being applied to the side of the object 508 as the label applicator 100 compresses against the object 508.

Figure 6:
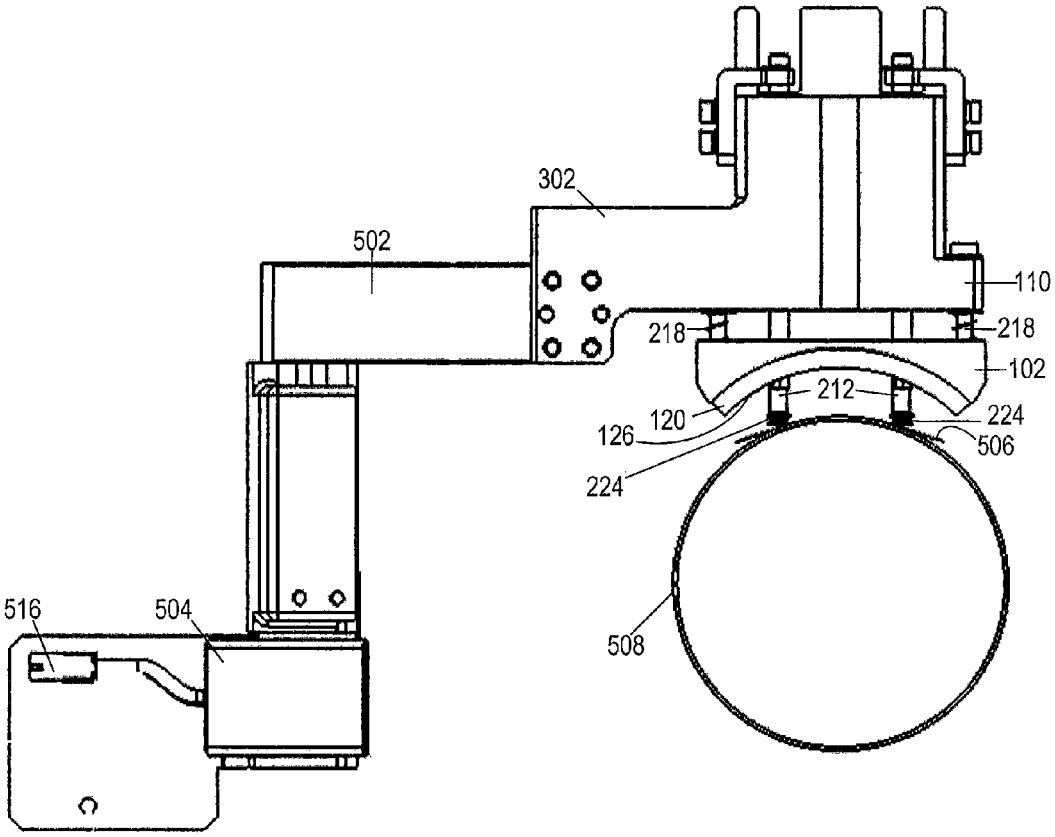
FIG. 6 is a view of a label applicator at a first stage of label application, in accordance with an embodiment of this disclosure.

FIG. 6 discloses a stage when the label applicator 100 initially contacts the label 506 against the side of the object 508. Prior to this stage, the label applicator may be in a neutral position and may receive the label 506 onto the first pair of resilient members 212. As shown in FIG. 6, the label 506 contacts the side of the object 508 when the label applicator 100 is moved towards the object 508. The label 506 deflects inward due to being pressed against the side of object 508 and the adhesive members 224 deform to assert a pressure against the side of the object 508. As discussed, the application force applied by deformation of the adhesive members 224 is low and therefore the stepper motor (not shown) is not likely to incur step loss when the label 506 is initially applied to the side of the object 508. In some embodiments, when the adhesive members 224 are fully compressed they do not apply a pressure against the side of the object 508.

Figure 7:
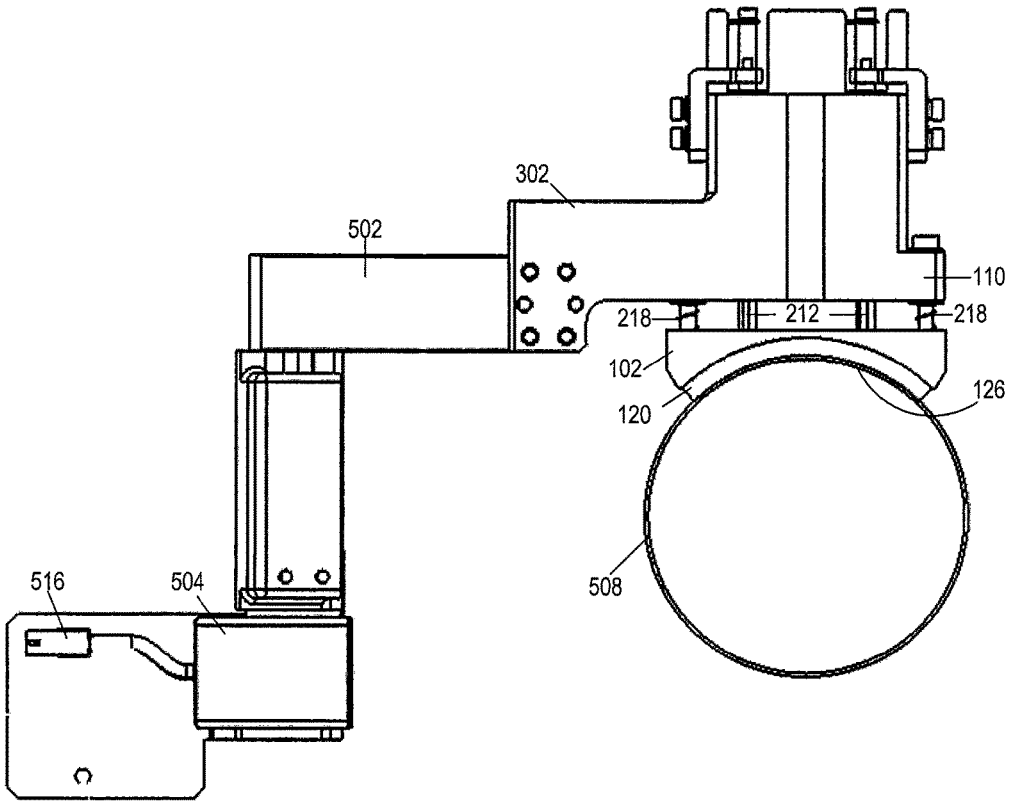
FIG. 7 is a view of a label applicator at a second stage of label application, in accordance with an embodiment of this disclosure.

Turning now to FIG. 7, a second stage of label application is illustrated. In this stage, the adhesive members 224 continue to be compressed and/or are fully compressed and the first pair of resilient members 212 start to be compressed. As shown, the first pair of resilient members 212 may compress until the object 508 comes into contact with the outer curved resilient surface 126 of the resilient surface 120, which is attached to the curved surface 108. The label 506, which is not visible in this view, may or may not be fully compressed against the side of the object 508, depending on the diameter of the object 508. In this stage, the application force applied to the side of the object 508 is a combination of the application force due to the deformed adhesive members 224 and the compression of the first pair of resilient members 212.

Figure 8:
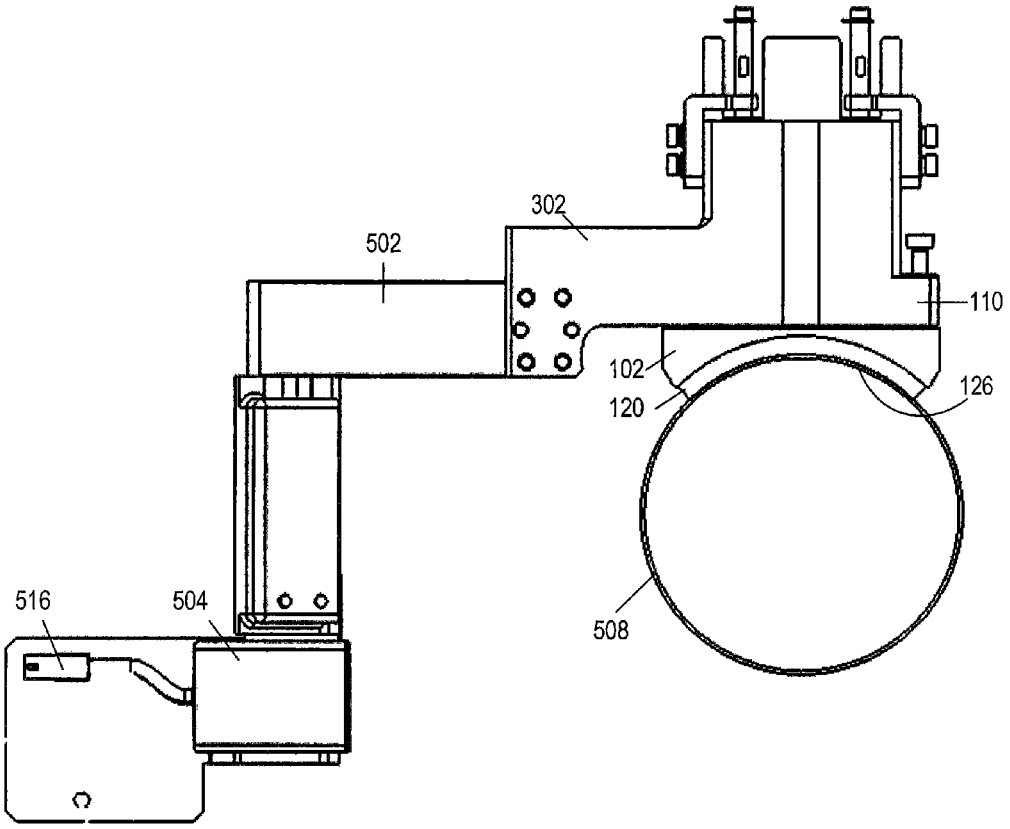
FIG. 8 is a view of a label applicator at a third stage of label application, in accordance with an embodiment of this disclosure.

In FIG. 8, a third stage of label application is illustrated. Here, the first pair of resilient members 212 continue to compress, and as the outer curved resilient surface 126 contacts the object 508 the outer curved resilient surface 126 pushes the body 102 towards the base 110 while the label applicator 100 is moving toward the object. As a result, the second pair of resilient members 218 compress, which decreases the distance between the body 102 and the base 110, and add to the application force being applied to the side of the object 508. Since members 218 are further away from the label applicator center line at midpoint 222 than members 212, pressure is distributed more evenly on the label 506 and members 218 continue to push air between the label 506 and object 508 towards the label end, thus preventing creation of air bubbles underneath the applied label. In some embodiments, the second pair of resilient members 218 have a lower spring constant, i.e., rigidity, than the resilient surface 120, which enables engagement of members 218 before engagement of the resilient surface 120.

Figure 9:
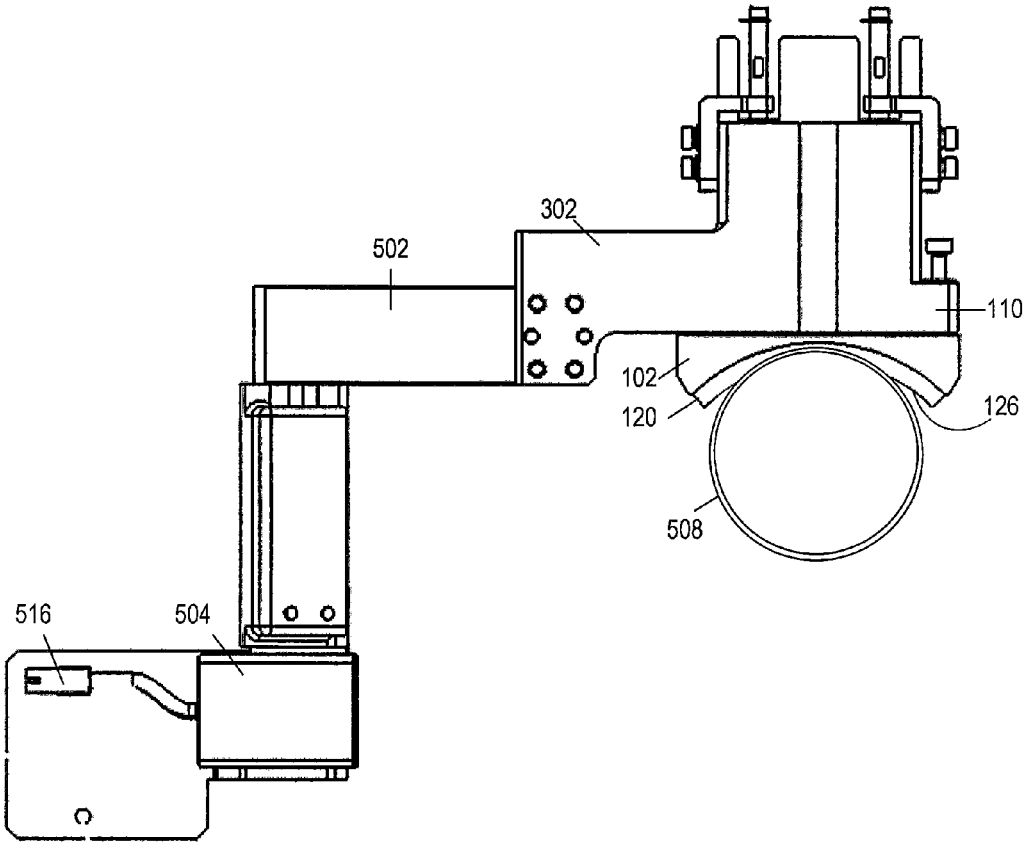
FIG. 9 is a view of a label applicator at a fourth stage of label application, in accordance with an embodiment of this disclosure.

In FIG. 9, a fourth stage of label application is illustrated. In the fourth stage, the resilient surface 120 attached to the curved surface 108 begins to compress. The fourth stage of label application may be used to apply labels 506 to objects 508 of different sizes and/or diameters. In FIGS. 6-8, the object 508 matches the outer curved resilient surface 126 and therefore the label is applied to the side of the object without deforming the resilient surface 120. If, however, the object 508 does not match the outer curved resilient surface 126 (as shown in FIG. 9), then the resilient surface 120 will conform to the side of the non-matching object and press the label against the side of the object along the length of the label. In some embodiments, the thickness and/or resiliency of the resilient surface 120 will be modified to permit the label applicator to apply labels to objects having a wide variety of diameters and/or sizes. For example, a thick, highly resilient surface 120 on the curved surface 108 may wrap around the edges of a variety of dish sizes and assist in compressing the label to the curved side of the dish.

It should be understood that the different stages do not need to occur in this order. For example, the pressure used to deform the resilient surface 120 may be less than the pressure used to compress the second pair of resilient members 218. When this occurs, the resilient surface 120 would deform first and then the second pair of resilient members 218 would compress.

In some embodiments, a label applicator system of the present invention includes a label verification system. When application of labels to objects is automated, it may be valuable to confirm that the labels have been correctly and accurately applied to the object. For example, a label verification system may confirm that a label has been applied to the side of a curved object and may confirm that the label is applied correctly, e.g., fully and without creases or bubbles under the label, i.e., that the content of the barcode or any other identifier on the label is readable by a scanner. Similarly, the system may confirm that the labels have passed from the printer to the object correctly and that the sequence or identifiers printed on the label are correct. Thus, a label verification system can assist in quality control of products labeled using the label applicator disclosed herein.

Figure 10:
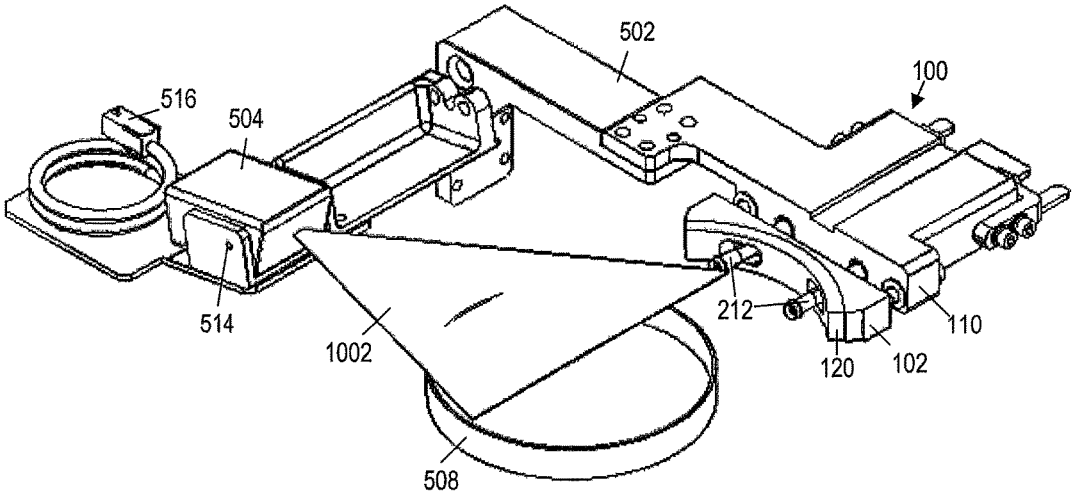
FIG. 10 is a perspective view of a label applicator and scanning device verifying label application, in accordance with an embodiment of this disclosure.

As shown in FIG. 10, a label applicator 100 and a scanning device configured to verify label application is provided, in accordance with an embodiment of this disclosure. In FIG. 10, the label (not shown) has been applied to the object 508 by the label applicator 100 and the object 508 is afterwards positioned so that applied label on object 508 faces the scanning device. As part of the verification system, the scanner 504 performs a scan 1002 of the label to confirm that the label has been applied correctly and/or is accurate and/or to capture information from the label. The scanner 504 may be a camera, infrared scanner, barcode scanner, or any other type of scanner known to one of skill in the art.

In an example embodiment, the scanner 504 scans in a vertical direction by moving about a vertical hinge 514 or by moving the vertical hinge 514 together with the scanner 504, arm 502 and label applicator 100 in a vertical direction. Scanning the label in a vertical sweeping motion permits the scanning device to capture the label when it is askew. In some embodiments, the scanner 504 continues its vertical sweep until the label is identified (e.g., the bar code on the label is scanned) and then the scanner 504 immediately halts scanning and returns to a ready position. It should be understood that the scanner 504 may move in a horizontal and/or vertical direction or may scan and/or take a picture of the label directly. The scanner 504 may be attached to the communication and/or power device 516 configured to communicate between the scanner 504, a computing device processor, and/or a motor.

Figure 11:
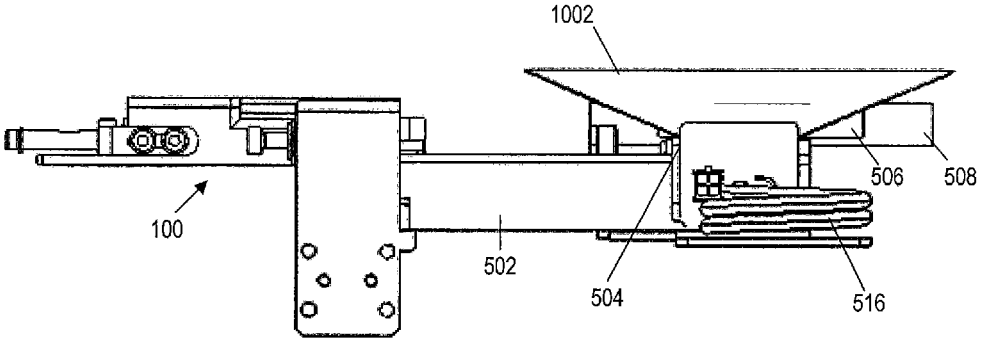
FIG. 11 is a side view of a label applicator and scanning device verifying label application, in accordance with an embodiment of this disclosure.

Turning now to FIG. 11, a side view of a label applicator 100 and a scanning device configured to verify label application is provided, in accordance with an embodiment of this disclosure. The side view provides an alternative view of the system disclosed in FIG. 10. An edge of the label 506 is illustrated as being attached to the side of the object 508. The scan 1002 from the scanner 504 moves in a vertical direction to confirm application and/or capture the information on the label 506.

Figure 12:
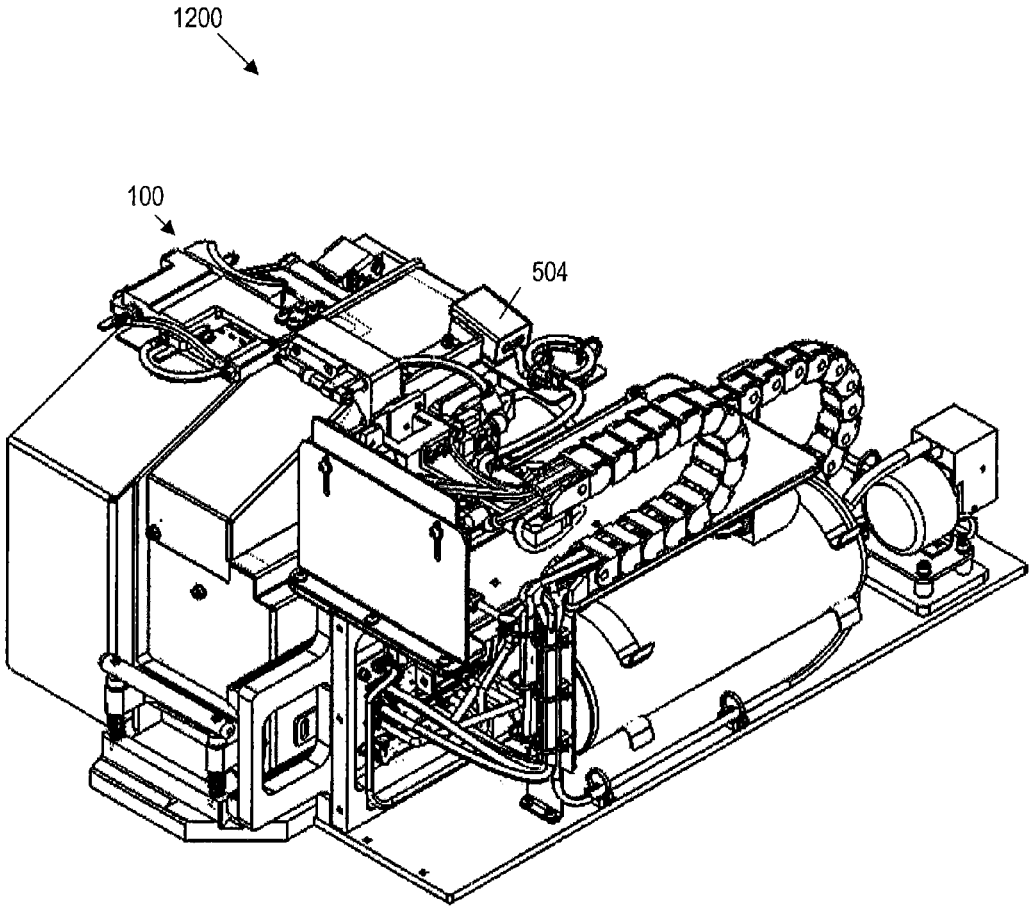
FIG. 12 is a perspective view of a system for applying labels using a label applicator, in accordance with an embodiment of this disclosure.

In some embodiments, the label applicator 100 and/or verification system may be included in an automated system 1200 for applying labels to the curved sides of objects. The system shown in FIG. 12 may be part of a larger system for preparing and/or using pre-loaded dishes and/or pre-poured media. As shown in FIG. 12, the automated system 1200 may include the label applicator 100 and the scanner 504. In an embodiment, the automated system 1200 also includes additional devices in order to quickly and accurately apply labels to the curved sides of objects. For example, the automated system may include a motor, computing device processor, printer, loading area for labels and/or objects, transportation options for the labels and/or objects, one or more power sources, and/or devices for packaging the objects once the label has been applied.

In some embodiments, the computing device processor is configured to control various parts of the automated system 1200 in order to print the labels, control the movement of objects, attach the labels to the label applicator 100, move the label applicator 100 towards the objects to adhere the labels, remove the labels from the label applicator 100, scan the labels, identify issues with the labels, record information on the labels, and/or package the labeled objects. The computing device processor may be a single processing device or a plurality of processing devices, and may variously include memory, a processor, computer readable code, and/or communication devices. In an embodiment, the computer readable code is stored in a non-transitory computer readable medium.

The motor may control movement of the label applicator 100 and/or movement of the objects. The motor may be an electric motor. For example, in some embodiments the motor is a stepper motor. In some embodiments, the motor incurs step loss when a high application force is quickly applied to the motor. Other types of motor may be used to control the movement of the label applicator 100 and/or labels. The motor or a second motor may be included in the automated system 1200 to control the scanner 504. For example, a second motor may control movement of the scanner 504 in a vertical sweeping motion to scan the label on the side of the object.

In some embodiments, the system 1200 includes a pressure sensor (not shown) designed to measure the application force being applied by the label applicator 100 to the object 508. The pressure sensor may be operatively linked to the computing device processor and/or the motor and configured to halt movement of the label applicator 100 towards the object 508 when a maximum application force is reached or exceeded.

Additional features and elements may be included in the automated system 1200 in order to provide additional functionality and/or safety.

In an embodiment, a label applicator of the present invention may be used as part of a method of applying labels to an object having a curved surface. For example, the method may include providing a label applicator as described herein; attaching the label to the second end of the at least one first resilient member; moving the label applicator towards an object having a curved surface; adhering the label to the curved surface using an increasing application force based at least on the first resilient member and the second resilient member; and detaching the label from the second end of the at least one first resilient member. In an embodiment, the increasing application force is further based on an adhesive member (e.g., suction cup) attached to the second end of the at least one first resilient member and/or a resilient surface attached to the curved surface. In some embodiments, the method also includes scanning the label using a scanner; and confirming that the object has been labeled. In further embodiments, the method includes monitoring the increasing application force; and halting movement of the label applicator towards the object when the increasing application force exceeds a predetermined limit.

Figure 13:
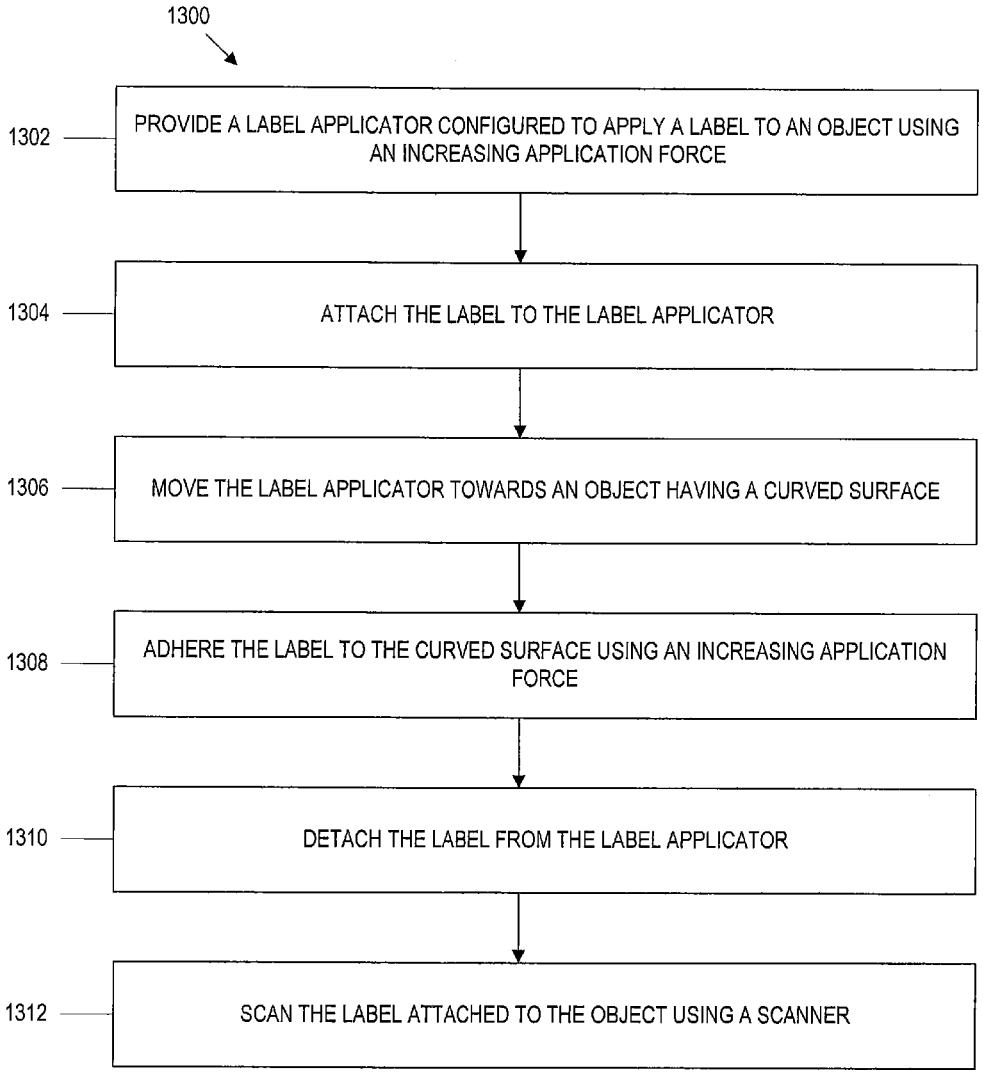
FIG. 13 is a flow chart of a method of applying a label using a label applicator, in accordance with an embodiment of this disclosure.

Turning now to FIG. 13, a flow chart 1300 of a method of applying a label using a label applicator is provided, in accordance with an embodiment of this disclosure. As shown in block 1302, the method includes providing a label applicator configured to apply a label to an object using an increasing application force. In some embodiments, the application force applied to the side of an object by the label applicator and/or a component thereof may increase over time and/or as the label applicator is moved and/or advanced toward the object. The label applicator may be any variant of the label applicator 100 disclosed herein. For example, the label applicator may be the embodiment shown in FIG. 1 or in FIG. 2.

In block 1304, the method includes attaching the label to the label applicator. For example, the label applicator may be moved to a printer to receive a label or the label may be moved to the label applicator. In an example embodiment, the label applicator moves vertically to a label dispenser, i.e., printer, which rotates the label around a drum and presents the label to be picked up by the label applicator. The label applicator then moves vertically to be in line with the object and moves horizontally to apply the label to the object. As discussed herein, the label may attach to the second end of the at least one first resilient member, e.g., via suction cups, magnets, adhesive, etc.

In block 1306, the method includes moving the label applicator towards an object having a curved surface. The object may be a Petri dish and/or cell culture dish. In some embodiments, the method includes moving the object towards the label applicator. In this embodiment, the label applicator may be stationary or moving less quickly than the object.

In block 1308, the method includes adhering the label to the curved surface of the object using an increasing application force. FIGS. 6-9 demonstrate how the label applicator initiates an increasing application force against the side of an object. For example, the initial contact may be a light force based on deformation of the adhesive member. After this, the first resilient member may begin to compress and increase the application force applied to the side of the object. When the object reaches the outer curved surface, the second resilient member begins to compress still further increasing the application force. Finally, in some embodiments the resilient surface begins to compress further increasing the application force on the label as it adheres to the side of the object. The label may adhere to the side of the object in a variety of ways. For example, the label may have an adhesive on it. Similarly, the side of the object may have an adhesive on it. In some embodiments, the label and the side of the object both include a non-adhesive substance that becomes adhesive when the label and the side of the object come into contact with one another.

In block 1310, the method includes detaching the label from the label applicator. In some embodiments, the detachment is active. For example, a vacuum associated with a suction cup may be turned off thereby releasing the label. In another example, an electromagnet is turned off to release the label. In further embodiments, the detachment is passive. For example, the label may be detached from the label applicator by securing the label to the object with a greater force than the label is secured to the adhesive member and then moving the object away from the label applicator. In this way, the adhesive force between the label applicator and the label is overcome and the label is detached.

In block 1312, the method includes scanning the label attached to the object using a scanner. In an embodiment, the scan is performed in a vertical sweep but horizontal and/or immobile scans may also be performed. Scanning the label may further comprise confirming that the label is correctly attached to the side of the object, that the label includes the correct information, and/or receiving information from the label.

In some embodiments, the method also includes monitoring the increasing application force and/or halting movement of the label applicator towards the object when the increasing application force exceeds a predetermined limit. For example, a pressure sensor may be included as part of the system and may monitor the application force to ensure that the label applicator provides sufficient force to adhere the label to the side of the object but does not apply so much force that the object is damaged.

Figure 14:
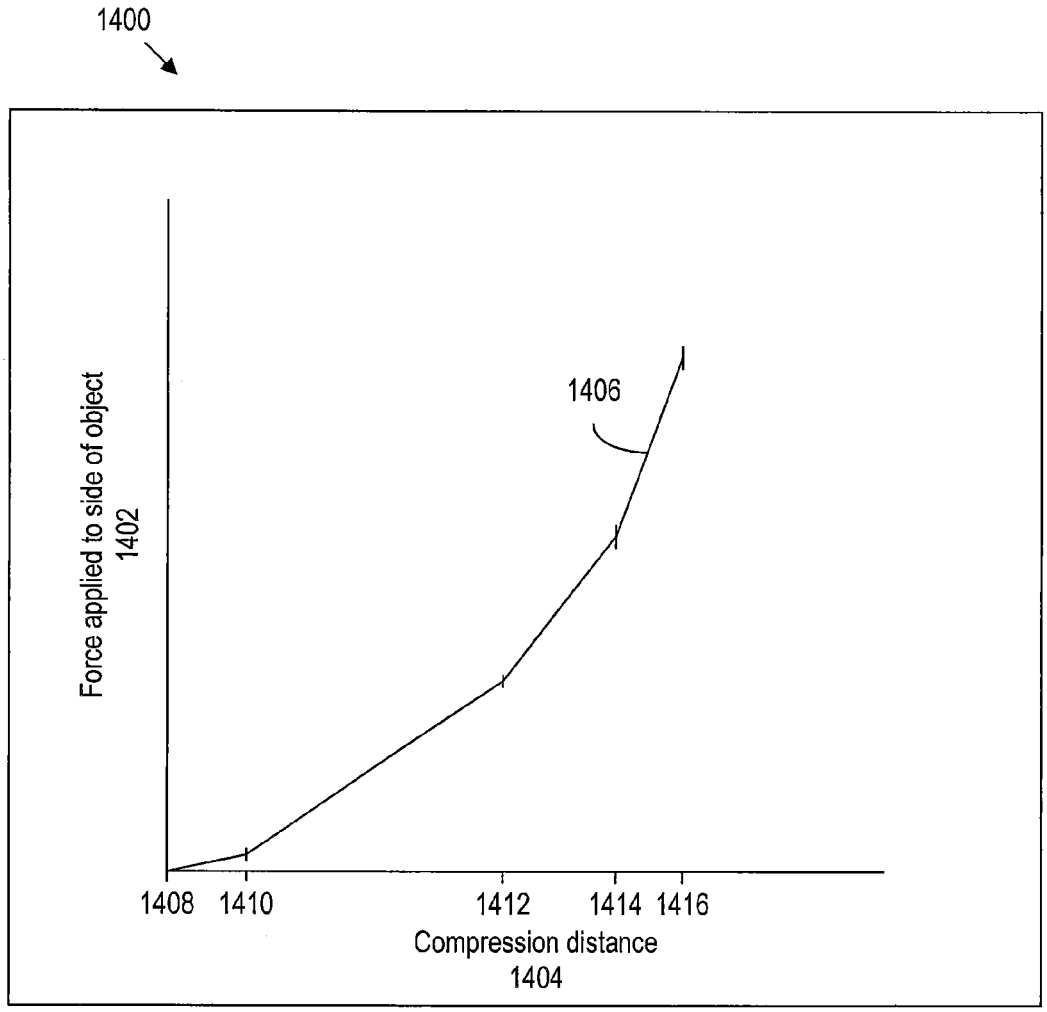
FIG. 14 is a chart of application force of the label applicator, in accordance with an embodiment of this disclosure.

FIG. 14 provides an example chart 1400 of application force 1406 of the label applicator, in accordance with an embodiment of this disclosure. The chart 1400 provides a measurement of force applied to the side of the object 1402 as a function of the compression distance 1404 of the label applicator. As seen in the chart 1400, the application force of the label applicator gradually increases, which reduces the chance of step loss in the stepper motor. Points are identified in the compression distance axis 1404 which correspond to engagement of different elements of the device. For example, the force applied to the side of the object is zero when the label applicator is in a neutral position and not compressed 1408. When the label initially contacts the side of the object, the force applied to the side of the object increases (e.g., the suction cup deforms) until the first resilient member is engaged at 1410. After the first resilient member is engaged, the force applied to the side of the object increases as the first resilient member is compressed. At point 1412, the object reaches the curved outer curved surface and the second resilient member also begins to be compressed, which results in increasing application of force to the side of the object. When point 1414 is reached, the application force begins to compress the resilient surface and the force applied to the side of the object increases still further. In some embodiments, the system includes a pressure relief value or pressure sensor that sets a maximum for the pressure applied to the object, such as at point 1416, to ensure that damage does not come to the object or label applicator system.

The method and chart illustrate that the disclosed device and system provide a novel and non-obvious solution to the problem of step loss when applying labels to a curved surface. It should be understood that not every step disclosed in the method must be performed in order to reduce step loss. For example, the resilient surface may provides the ability to apply labels to objects of various sizes and/or diameters. If the system is designed for a single-sized object, then the label applicator may not include the resilient surface but still falls within the scope of this disclosure.

The present invention is described in part with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The flowcharts and block diagrams of certain of the figures herein illustrate exemplary architecture, functionality, and operation of possible implementations of embodiments of the present invention. It should be noted that in some alternative implementations, the steps noted in the blocks may occur out of the order noted in the figures. For example, two blocks shown in succession may in fact be executed substantially concurrently or the blocks may sometimes be executed in the reverse order or two or more blocks may be combined, depending upon the functionality involved.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

The invention claimed is:

1. A label applicator comprising:

a body having a first side and a second side, the second side comprising a curved surface, wherein at least one pathway extends from the first side of the body to the curved surface on the second side of the body;

a base positioned proximate to the first side of the body;

at least one first resilient member having a defined length between a first end and a second end, wherein the at least one first resilient member extends through the at least one pathway, the first end of the at least one first resilient member engages with the base, and the second end of the at least one first resilient member extends beyond the curved surface; and at least one second resilient member engaging the body and the base, wherein the second end of the at least one first resilient member is configured to removably attach to a label, wherein the at least one first resilient member moves independently of the body such that pressure initially applied to the label as the label is attached to the second end compresses the second end toward the curved surface of the body, and wherein, upon the pressure causing the second end to reach the curved surface, further pressure compresses the body toward the base.

2. The label applicator of claim 1, wherein the at least one pathway comprises two channels defined by the body, the two channels positioned on opposite sides of a midpoint of the curved surface.

3. The label applicator of claim 1, further comprising an adhesive member on the second end of the at least one first resilient member.

4. The label applicator of claim 3, wherein the adhesive member is selected from the group consisting of a suction cup, an adhesive surface, a magnet, and a vacuum tube.

5. The label applicator of claim 1, further comprising a resilient surface attached to the curved surface.

6. The label applicator of claim 5, wherein the resilient surface is selected from the group consisting of a foam pad, a spring-loaded surface, and a bladder.

7. The label applicator of claim 1, wherein the at least one first resilient member is selected from the group consisting of a spring and a pneumatic device.

8. The label applicator of claim 1, wherein the at least one second resilient member is selected from the group consisting of a spring, a compressive polymer, a pneumatic device, foam, and a bladder.

9. A label applicator system comprising:

a label applicator comprising:

a body having a first side and a second side and defining two channels extending through the body from the first side to a curved surface on the second side, the two channels positioned on opposing sides of a midpoint of the curved surface;

a base positioned proximate to the first side of the body;

a first pair of resilient members extending through the two channels and having a first end engaging with the base and a second end at a position beyond the curved surface;

a second pair of resilient members engaging with the body and the base, and wherein the second ends of the first pair of resilient members are configured to removably attach to a label; and wherein the first pair of resilient members move independently of the body such that pressure initially applied to the label as the label is attached to the second ends compresses the second ends toward the curved surface of the body, and wherein, upon the pressure causing the second ends to reach the curved surface, further pressure compresses the body toward the base.

10. The label applicator system of claim 9, further comprising adhesive members attached to the second ends of the first pair of resilient members, the adhesive members selected from the group consisting of suction cups, adhesive surfaces, magnets, and vacuum tubes.

11. The label applicator system of claim 9, further comprising a resilient surface attached to the curved surface, the resilient surface selected from the group consisting of a foam pad, a spring-loaded surface, and a bladder.

12. The label applicator system of claim 9, further comprising a movable arm configured to move the base of the label applicator.

13. The label applicator system of claim 12, further comprising a step motor operably connected to the movable arm and configured to move the movable arm in at least one plane.

14. The label applicator system of claim 13, further comprising a pressure sensor configured to monitor an application force of the label applicator by the step motor and halt movement of the label applicator when a predetermined limit is exceeded.

15. The label applicator system of claim 9, further comprising a scanner configured to capture information on the label after the label has been applied to a surface of an object.

* * * * *